United States Patent [19]

Schnall et al.

[11] 4,150,892

[45] Apr. 24, 1979

[54] TONER DISPENSING DEVICE FOR AN ELECTROSTATIC COPIER

[75] Inventors: Günther Schnall, Eching; Erich Schlick, Riedmoos; Hanns Blöchl, Unterhaching, all of Fed. Rep. of Germany

[73] Assignee: AGFA-Gevaert A.G., Leverkusen, Fed. Rep. of Germany

[21] Appl. No.: 829,984

[22] Filed: Sep. 1, 1977

[30] Foreign Application Priority Data

Sep. 3, 1976 [DE] Fed. Rep. of Germany ..... 2639666

[51] Int. Cl.[2] ..... G03G 15/00; G03G 15/06

[52] U.S. Cl. ..... 355/3 DD; 118/646; 118/653; 222/DIG. 1

[58] Field of Search ..... 355/3 R, 3 DD; 118/646, 118/653; 222/DIG. 1

[56] References Cited

U.S. PATENT DOCUMENTS

| | | | |
|---|---|---|---|
| 3,067,720 | 12/1962 | Lewis et al. | 355/14 X |
| 3,671,119 | 6/1972 | Engel et al. | 355/3 DR X |
| 3,898,956 | 8/1975 | Andrako | 118/646 |
| 3,912,388 | 10/1975 | Takahashi et al. | 355/3 DD |
| 3,946,910 | 3/1976 | Case | 222/DIG. 1 X |

*Primary Examiner*—Fred L. Braun
*Attorney, Agent, or Firm*—Michael J. Striker

[57] ABSTRACT

An arrangement for transporting toner from a supply to a latent-image developing station of an electrostatic copier. The arrangement includes a rotatable transporting element having a shaft, an eccentric cam spaced from the shaft, a pivot arm pivotable into and out of contact with the cam and a freewheel drive connecting it with the shaft, and an adjustable stop which determines the extent to which the pivot arm can pivot towards the cam.

5 Claims, 3 Drawing Figures

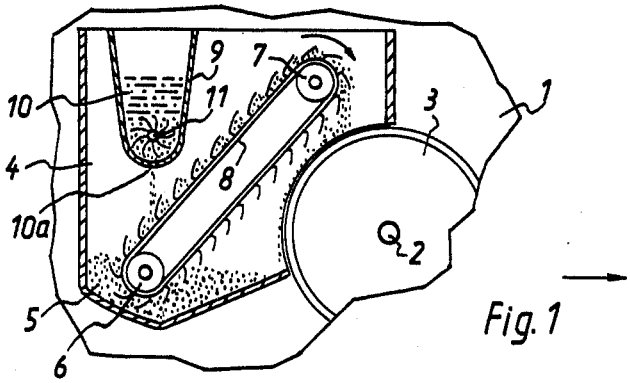
Fig. 1
Fig. 2
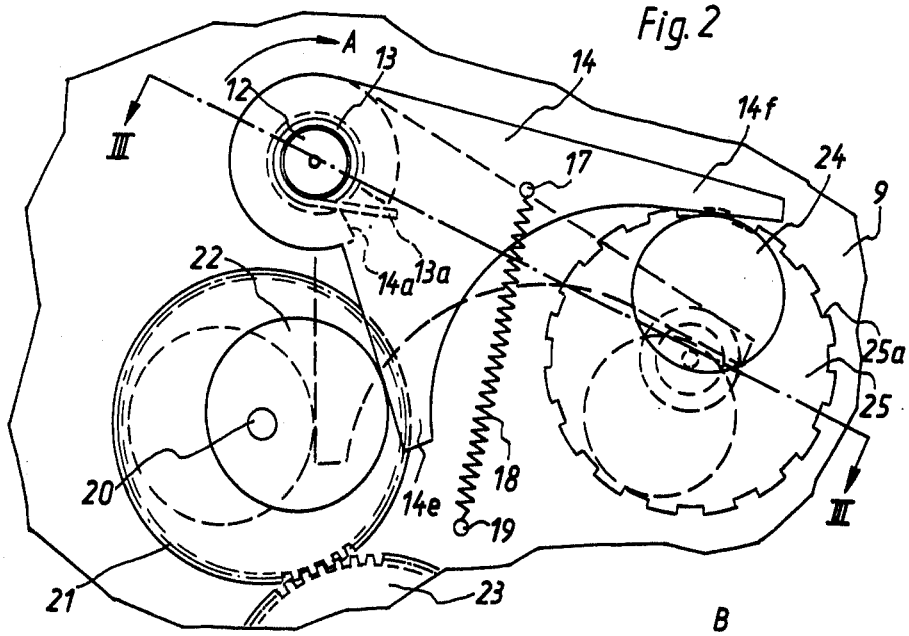
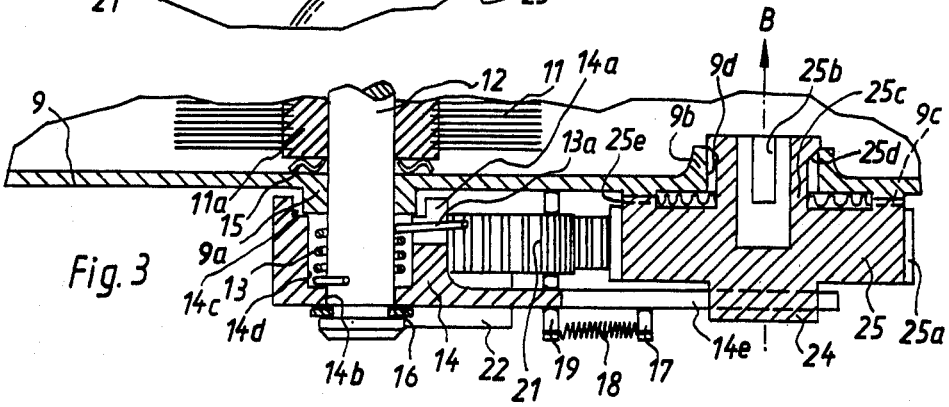
Fig. 3

TONER DISPENSING DEVICE FOR AN ELECTROSTATIC COPIER

BACKGROUND OF THE INVENTION

1. Field of Invention

The present invention relates to electrostatic copiers.

More particularly, the invention relates to an arrangement for transporting toner particles from a supply to a latent-image developing station of an electrostatic copier.

Specifically, the invention relates to an arrangement of the type in question, which permits the amount of toner that is supplied to the developing station per unit time, to be selectively varied.

2. The Prior Art

An arrangement of this general type is known from German Allowed Application No. 1,954,323. There, toner particles are received in a container having a perforated bottom. A brush rotates in the container and its bristles enter the perforations and permit toner particles to fall through the same and onto a conveyor. The amount of particles supplied per unit time can be varied by varying the speed of rotation of the brush; the number of revolutions of the brush can be varied stepwise or intermittently by a certain extent per unit time.

The arrangements for effecting these stepwise or intermittent adjustments are rather complicated and therefore expensive. Moreover, they do not permit small adjustments; only rather imprecise ones which, therefore, result in similarly imprecise variations in the quantity of toner that is forwarded for unit time.

SUMMARY OF THE INVENTION

It is an object of the present invention to improve on the prior art.

More particularly, it is an object to provide an arrangement of the type in question, in which the amount of toner forwarded per unit time can be varied in increments of any desired size, and can even be varied continuously (steplessly).

Another object is to provide such an arrangement which is highly reliable in operation.

A concomitant object is to provide such an arrangement which is simple and inexpensive to construct.

In keeping with these objects and with still others which will become apparent hereafter, one feature of the invention resides, in an electrostatic copier, in a combination comprising a developing station at which latent electrostatic images are developed by attracting toner particles to them; a toner supply; and means for transporting toner from the toner supply to the developing station including a rotatable transporting element having a shaft, a rotatable eccentric cam spaced from the shaft, a pivot arm pivotable into and out of engagement with the eccentric cam, a free-wheel drive connecting the shaft with the pivot arm, and adjustable stop means for limiting the movement of said pivot arm in direction towards the eccentric cam to a selectable extent, whereby the amount of toner transported to the developing station by the transporting element per unit time varies as a function of the selection of the extent.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a fragmentary sectional view showing the developing station and the toner transporting arrangement of an electrostatic copier;

FIG. 2 is a side view, illustrating an arrangement according to the present invention; and FIG. 3 is a section taken on line III—III of FIG. 2.

DESCRIPTION OF A PREFERRED EMBODIMENT

The conventional arrangement and cooperation (applicable also to the present invention) of the image developing station and the toner transporting mechanism of an electrostatic copier, are illustrated in FIG. 1.

Reference numeral 1 identifies a frame or housing in which a copying drum 3 is mounted for rotation on a shaft 2. The circumference of the drum 3 is provided with a photoconductive layer. Adjacent to the drum 3 is mounted the housing 4 of a toner supply station; the lower part of housing 4 contains a supply 5 of toner particles (a mixture of toner and carrier particles). Rollers 6 and 7 are mounted on housing 4 and support a scoop conveyor 8 which, when advanced (by e.g. driven rollers 6 or 7) scoops up toner from supply 5, conveys it upwardly and then cascades it over the surface of drum 3, where it is attracted to a latent electrostatic image on the drum surface to develop this image.

A second housing or container 9 is mounted on or in housing 4; it contains a supply 10 of toner particles which serves to replenish the supply 5. A brush 11 forms part of the toner transporting means of the arrangement and rotates on shaft 12 in the housing 9. The latter has openings **10*a* through which the brush 11 pushes toner from supply 10 to drop onto the conveyor 8. Excess particles which overfill the scoops of the conveyor, and those which do not adhere to the drum 3, drop back into the supply 5. It is evident that the amount of toner particles entering the housing 4 from the housing 9 is approximately a linear function of the speed of rotation (RPM) of the brush 11. This is of course true, even if the brush 11** is replaced with another element, such as e.g. a cylinder formed with grooves in its surface, a perforated reciprocatory slider, or the like.

The invention provides an arrangement for varying the rotational speed of the brush 11, or, more generally, for varying the operating cycle of any element which performs the function of the brush 11.

The Structure

As shown in FIGS. 2 and 3, a loop-spring 13 embraces the shaft 12 of brush 11. The diameter of spring 13 in unstressed condition is such that it surrounds and engages the shaft 12 with slight pressure.

One end **13*a* of spring 13 is engaged in a slot 14*a* of a pivot or swing arm 14 so that, if the latter is pivoted in the direction of arrow A, the convolutions of spring 13 open up (i.e., their diameter increases) with a resulting reduction of the pressure-engagement between the spring and the shaft 12. If a sufficient retarding moment acts upon the shaft 12 and the brush 11, they do not participate in this pivoting movement of the arm 14. Such a retarding moment is needed and will normally be supplied by the inherent friction (journal friction on shaft 12, resistance offered to brush 11 by toner supply 10). If that should not be enough, additional retarding moment can be supplied by installing a spring-biased brake disk 15 on the shaft 12, which increases the friction between core 11***a* of brush 11 and the housing 9.

Pivoting of the arm 14 counter to arrow A has the converse effect; it causes the convolutions of spring 13 to contract and to more tightly grip the shaft 12, so that it can entrain the shaft even against a substantial retarding moment. An increase in the resistance offered to such entrainment also automatically results in further contraction of the spring convolutions and still firmer gripping of shaft 12 by spring 13. As will be seen from the above, the spring 13 is a freewheel drive which connects shaft 12 with arm 14, i.e. a drive which permits freewheeling (no entrainment) in one direction and imposes entrainment in the other direction.

Pivot arm 14 has a bore 14*b* with which it is journalled on shaft 12; it also has a projection 14*c* by means of which it is mounted on a flange 9*a* of housing 9. A circlip 16 holds it in place. Spring 13 is received in a bore 14*d* having a diameter which is sufficiently large to permit the desired expansion of its convolutions (so that it can permit "freewheeling"). One end of a contraction spring 18 is secured to a pin 17 of arm 14; the other end is secured to a pin 19 on housing 9, so that the spring exerts torque upon arm 14 in direction of the arrow A.

A shaft 20 is mounted in housing 9 and carries a gear 21 which is provided with an eccentric cam 22. Gear 21 meshes with a further gear 23; the latter is driven (not illustrated) by a constant drive derived from the copier drive arrangement. For example, gear 23 could be mounted on the shaft of one of the rollers 6, 7 or it could be connected in some other way with the drive for conveyor 8 to receive motion therefrom.

One section 14*e* of pivot arm 14 is urged into contact with the eccentric cam 22 by the spring 18. Another section 14*f* of the arm 14 engages an adjustable stop means in form of an eccentric element 24 which is mounted on a setting knob 25. The outer periphery of the knob 25 is provided with grooves or flutings 25*a* to assure a better grip. A tubular extension 25*c* of knob 25 is provided with an axial slot 25*b*, so as to make it resiliently yieldable in radial direction; both of the thus obtained halves of the extension 25*c* are formed with inclined retaining portions or surfaces 25*d* which resiliently engage behind a bore 9*d* formed for knob 25 in a flange 9*d* of housing, so as to exert a biasing force upon knob 25 in direction of the arrow B. This biasing force draws the knob 25 inwardly and maintains cooperating detent portions 25*e* of the knob 25 and 9*c* of the housing 9 in engagement with one another. Thus, to set the position of eccentric element 24, knob 25 is pulled out until the portions 25*e*, 9*c* disengage; it is then turned until the desired position is reached for eccentric element 24 and released. Knob 25 returns to its original position, portions 25*e*, 9*c* interengage and the eccentric element is locked against undesired rotation. This is possible for a large number of different angular positions of the eccentric element 24.

The Operation

When the eccentric element 24 is in the broken-line position of FIG. 2, the arm 14 can track the cam 22 during the rotation thereof until it reaches the end position which is also shown in broken lines. The brush 11 is thus rotated stepwise, by one step whenever the arm 14 returns to its starting position in direction counter to the arrow A. By adjusting the element 24 appropriately, the arm 14 can be prevented completely or partially from tracking the cam 22; if that is done, then the movement of the arm 14 in both directions is shortened and the length of the steps by which the brush 11 is rotated (i.e. its degree of angular displacement) is correspondingly reduced. When the element 24 assumes the position shown in full lines in FIG. 2, the angular displacement of brush 11 is completely stopped.

It will be seen, therefore, that the angular displacement of brush 11 (and the amount of toner supplied by it per unit time) can be adjusted in large or small steps of any desired size, and can even be varied steplessly. This is, of course, analogously true of an element that might be used in place of the brush 11, such as the earlier-mentioned cylinder or slider.

The knob 25 is preferably of synthetic plastic material and of one piece with the element 24. However, other materials can be used and the two elements could be discrete but connected with one another.

While the invention has been illustrated and described as embodied in a toner transporting arrangement, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In an electrostatic copier, a combination comprising a developing station at which latent electrostatic images are developed by attracting toner particles to them; a toner supply; and means for transporting toner from said toner supply to said developing station, including a rotatable transporting element having a shaft, a rotatable eccentric cam spaced from said shaft, a pivot arm pivotable into and out of engagement with said eccentric cam, a freewheel drive connecting said shaft with said pivot arm, and adjustable stop means for limiting the movement of said pivot arm in direction towards said eccentric cam to a selectable extent, whereby the amount of toner transported to said developing station by said transporting element per unit time varies as a function of the selection of said extent, said stop means comprising an eccentric element and a handgrip on the same, and said eccentric element being a turnable knob having an outer gripping side facing away from the copier and an inner side facing towards the copier, means for yieldably urging said knob towards the copier, and cooperating detents on said inner side and the copier.

2. A combination as defined in claim 1, wherein said pivot arm and said freewheel drive both turn about the same axis as said shaft of said transporting element.

3. A combination as defined in claim 2, wherein said freewheel drive comprises a looped spring which embraces said shaft of said transporting element.

4. A combination as defined in claim 1, said means for yieldably urging comprising a resilient projecting hub extending from said inner side of said knob.

5. A combination as defined in claim 1, wherein said knob is of synthetic plastic material.

* * * * *